US006526753B1

(12) United States Patent
Bailey

(10) Patent No.: US 6,526,753 B1
(45) Date of Patent: Mar. 4, 2003

(54) EXHAUST GAS REGENERATOR/PARTICULATE TRAP FOR AN INTERNAL COMBUSTION ENGINE

(75) Inventor: Brett M. Bailey, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 46 days.

(21) Appl. No.: 10/024,053

(22) Filed: Dec. 17, 2001

(51) Int. Cl.[7] ..... F02B 33/44
(52) U.S. Cl. ..... 60/605.2; 60/605.1
(58) Field of Search ..... 60/605.1, 605.2, 60/597

(56) References Cited

U.S. PATENT DOCUMENTS

| | | | | |
|---|---|---|---|---|
| 3,774,399 A | | 11/1973 | Nohira et al. | |
| 4,291,760 A | | 9/1981 | Argyle et al. | |
| 5,205,265 A | | 4/1993 | Kashiyama et al. | |
| 5,440,880 A | | 8/1995 | Ceynow et al. | |
| 5,546,915 A | | 8/1996 | Isobe | |
| 5,607,010 A | | 3/1997 | Schonfeld et al. | |
| 5,617,726 A | | 4/1997 | Sheridan et al. | |
| 5,657,630 A | | 8/1997 | Kjemtrup et al. | |
| 5,732,688 A | | 3/1998 | Charlton et al. | |
| 5,771,868 A | | 6/1998 | Khair | |
| 5,806,308 A | | 9/1998 | Khair et al. | |
| 6,009,709 A | | 1/2000 | Bailey | |
| 6,038,860 A | * | 3/2000 | Bailey | 60/605.2 |
| 6,067,973 A | * | 5/2000 | Chanda et al. | 123/585 |
| 6,216,458 B1 | * | 4/2001 | Alger et al. | 60/605.2 |

* cited by examiner

*Primary Examiner*—Hoang Nguyen
(74) *Attorney, Agent, or Firm*—Todd Taylor

(57) ABSTRACT

An exhaust gas regenerator/particulate capture system is provided with a first particulate trap and a second particulate trap. A regenerator valve is provided having a valve member, an EGR inlet port, and a purge air outlet port. The valve member is operable between a first position and a second position. When the valve member is in the first position, the EGR inlet port is connected in fluid communication with the first particulate trap and the purge air outlet port is connected in fluid communication with the second particulate trap. When the valve member is in the second position, the EGR inlet port is connected in fluid communication with the second particulate trap and the purge air outlet port is connected in fluid communication with the first particulate trap.

17 Claims, 2 Drawing Sheets

EXHAUST GAS REGENERATOR/PARTICULATE TRAP FOR AN INTERNAL COMBUSTION ENGINE

TECHNICAL FIELD

This invention relates generally to an internal combustion engine and, more particularly, to an exhaust gas regenerator/particulate trap for an internal combustion engine.

BACKGROUND

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas, which is introduced to the engine cylinder, reduces the concentration of oxygen therein, which in turn lowers the maximum combustion temperature within the cylinder and slows the chemical reaction of the combustion process, thereby decreasing the formation of nitrous oxides (NOx). Furthermore, the exhaust gases typically contain unburned hydrocarbons, which are burned on reintroduction into the engine cylinder, which further reduces the emission of exhaust gas by-products which would be emitted as undesirable pollutants from the internal combustion engine.

In many EGR applications, the exhaust gas is diverted by an EGR valve directly from the exhaust manifold. The percentage of the total exhaust flow which is diverted for reintroduction into the intake manifold of an internal combustion engine is known as the EGR flow rate of the engine.

Some internal combustion engines include turbochargers to increase engine performance, and are available in a variety of configurations. For example, fixed housing turbochargers have a fixed exhaust inlet nozzle that accelerates exhaust gas towards a turbine wheel, which in turn rotates a compressor. Also, a variable nozzle turbocharger (VNT) has a variable nozzle having a ring of a plurality of variable vanes which are controlled to change the cross sectional area through which the exhaust gases pass to reach the turbine. In a VNT, the smaller the nozzle opening, the faster the gas velocity to the turbine, and in turn, the higher the boost. Still further, it is known to provide a turbocharger having two independent compressors, which is known as a double sided compressor.

When utilizing EGR in a turbocharged diesel engine, the exhaust gas to be recirculated is often removed upstream of the exhaust gas driven turbine associated with the turbocharger. The recirculated exhaust gas is typically introduced to the intake air stream downstream of the compressor and air-to-air after-cooler (ATAAC). Reintroducing the exhaust gas downstream of the compressor and ATAAC is preferred in some systems due to the reliability and maintainability concerns that arise if the exhaust gas passes through the compressor and ATAAC.

The recirculated exhaust gas includes particulate matter that can adversely affect the performance of the internal combustion engine by contaminating the intake air stream with the particulate matter. As disclosed in U.S. Pat. No. 5,617,726, a filter can be used to remove particulate matter from the exhaust gas that is being fed back to the intake air stream for recirculation. However, such filters are prone to clogging and must be periodically removed for cleaning.

The present invention is directed to overcoming one or more of the problems or disadvantages associated with the prior art.

SUMMARY OF THE INVENTION

In one aspect of the invention, an exhaust gas regenerator/particulate capture system is provided having a first particulate trap and a second particulate trap. The first particulate trap has a first particulate filter and the second particulate trap has a second particulate filter. A regenerator valve is provided having a valve member, an EGR inlet port, a purge air outlet port, a first particulate trap port and a second particulate trap port. The first particulate trap port is connected in fluid communication with a fluid port of the first particulate trap and a second particulate trap port is connected in fluid communication with a fluid port of the second particulate trap. The valve member is operable between a first position and a second position. When the valve member is in the first position, the EGR inlet port is connected in fluid communication with the first particulate trap and the purge air outlet is connected in fluid communication with the second particulate trap. When the valve member is in the second position, the EGR inlet port is connected in fluid communication with the second particulate trap and the purge air outlet is connected in fluid communication with the first particulate trap.

In another aspect of the invention, a method of filtering EGR gases is provided having the steps of: establishing an EGR gases fluid flow; establishing a compressed air fluid flow; positioning a valve member in a first position to effect the EGR gases fluid flow in a first direction through a first particulate trap and to effect a compressed air fluid flow in a second direction opposite to the first direction through a second particulate trap; and positioning the valve member in a second position to effect the EGR gases fluid flow in the first direction through the second particulate trap and to effect the compressed air fluid flow in the second direction opposite to the first direction through the first particulate trap.

DETAILED DESCRIPTION

Figure 1:
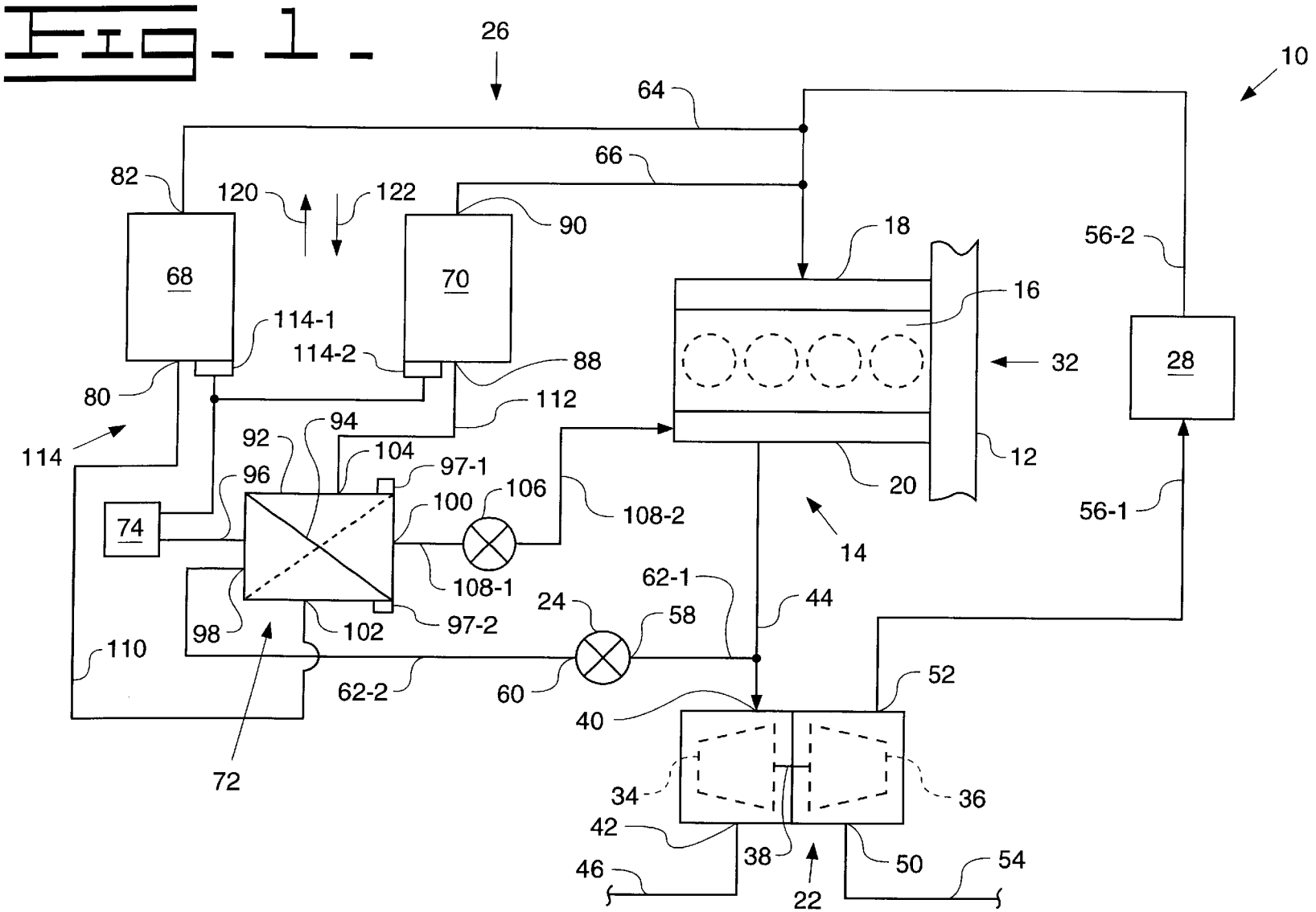
FIG. 1 is a graphical illustration of an internal combustion engine embodying the exhaust gas regenerator/particulate capture system of the invention.

Referring the drawings, there is shown in FIG. 1 a work machine 10 having a frame 12 to which an internal combustion engine 14 is attached. Internal combustion engine 14 includes a block 16, an intake manifold 18, an exhaust manifold 20, a turbocharger 22, an EGR source 24, an exhaust gas regenerator/particulate trap system 26, and an ATAAC 28.

As used herein, block 16 includes both an engine block and cylinder head. Block 16 of internal combustion engine 14 includes a plurality of combustion cylinders 32 (shown schematically by dashed circles), and corresponding plurality of reciprocating pistons (not shown), each coupled a crankshaft by a connecting rod (not shown). The general operation of the components included in block 16 is well known in the art, and for the sake of brevity, will not be further discussed herein.

Intake manifold 18 is connected to block 16 to supply combustion air to combustion cylinders 32. The combustion air includes both compressed fresh air supplied from turbocharger 22 and EGR gases supplied from EGR source 24.

Exhaust manifold 20 is connected to block 16 to receive combustion gases (also referred to as exhaust gases) from combustion cylinders 32 following the combustion of an air/fuel mixture in combustion cylinders 32.

Turbocharger 22 includes a turbine 34 and a compressor 36. Turbine 34 and compressor 36 are connected for mutual rotation via a shaft 38.

Turbine 34 has an exhaust gas inlet port 40 and an exhaust gas outlet port 42. Exhaust gas inlet port 40 of turbine 34 is coupled in fluid communication to exhaust manifold 20 via exhaust conduit 44. Exhaust gas outlet port 42 is coupled in fluid communication with the atmosphere via an exhaust pipe 46.

Compressor 36 has an air inlet port 50 and an air outlet port 52. Air inlet port 50 is connected in fluid communication with the atmosphere via conduit 54 to receive air for combustion. Air outlet port 52 is coupled in fluid communication with intake manifold 18 via ATAAC 28 and conduit 56 having segments 56-1 and 56-2.

EGR source 24 may be, for example, a valve that diverts a portion of the total flow of exhaust gases from exhaust manifold 20 to effect EGR. As shown, EGR source 24 has an EGR inlet 58 and an EGR outlet 60. EGR inlet 58 is coupled in fluid communication with exhaust manifold 20 via exhaust conduit 44 and an EGR conduit segment 62-1. ERG outlet 60 is coupled in fluid communication with intake manifold 18 via a conduit segment 62-2, exhaust gas regenerator/particulate trap system 26, conduits 64 and 66, and conduit 56-2.

Exhaust gas regenerator/particulate trap system 26 has a first particulate trap 68, a second particulate trap 70, regenerator valve 72, and a drive source 74.

Figure 2:
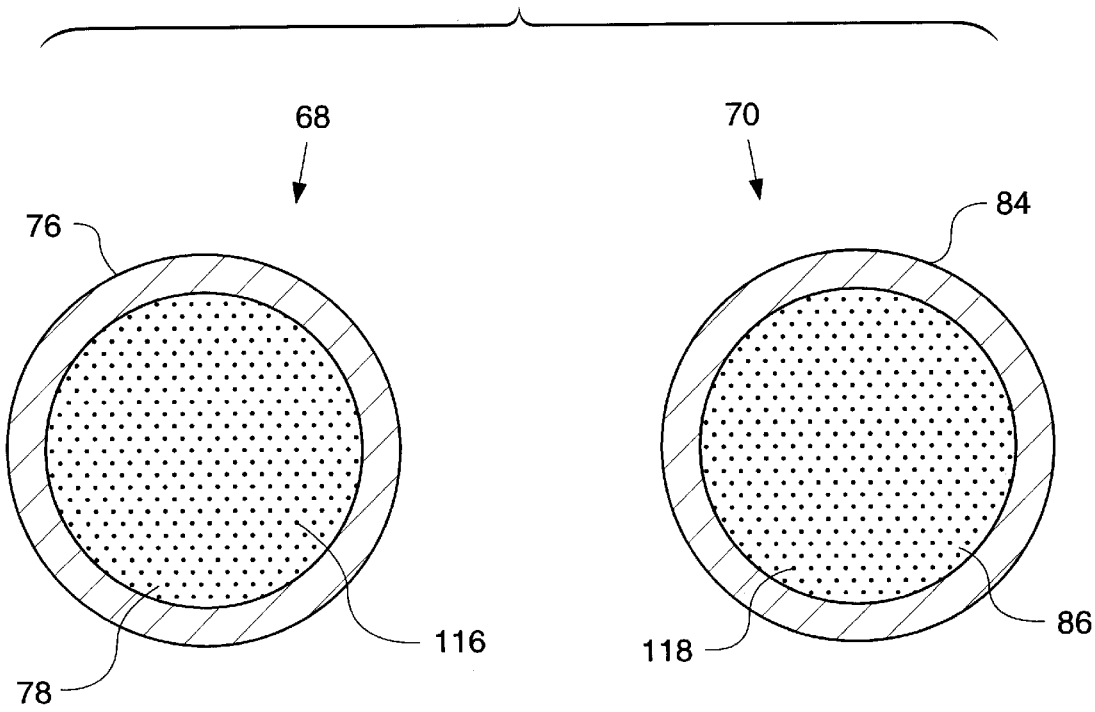
FIG. 2 is a sectional view of the first and second particulate traps of the present invention.

Referring to FIGS. 1 and 2, first particulate trap 68 has a first housing 76 containing a first particulate filter 78. First housing 76 includes a first fluid port 80 and a second fluid port 82. Second particulate trap 70 has a second housing 84 containing a second particulate filter 86. Second housing 84 has a third fluid port 88 and a fourth fluid port 90.

As schematically illustrated in FIG. 1, regenerator valve 72 has a valve body 92 and a valve member 94. Valve member 94 is shown in a first position by a solid line and is shown in a second position by a dashed line. Valve member 94 is coupled to a shaft 96, wherein shaft 96 rotatable within valve body 92, thereby permitting valve member 94 to be rotatably positioned at either of the first and second positions by the clockwise or counter clockwise rotation of valve member 94 into engagement with one of rotation impeding elements 97-1 and 97-2, respectively.

Valve body 92 has an EGR inlet port 98, a purge air outlet port 100, a first particulate trap port 102 and a second particulate trap port 104. EGR inlet port 98 is connected in fluid communication with EGR source 24 via conduit segment 62-2. Purge air outlet port 100 is connected in fluid communication with exhaust manifold 20 via a purge air valve 106 and conduit segments 108-1 and 108-2. First particulate trap port 102 is connected in fluid communication with first fluid port 80 of first particulate trap 68 via conduit 110.

Second particulate trap port 104 is connected in fluid communication with third fluid port 88 of second particulate trap 70 via conduit 112.

In the present embodiment, bleed air is provided by bleeding compressed air from conduit segment 56-2 downstream of ATAAC 28. It is contemplated that the bleed air could be bled directly from air outlet port 52 of compressor 36, or bled at any point in conduit segment 56-1 upstream of ATAAC 28. Still further, it is contemplated that ATAAC could be removed altogether, if desired.

Drive source 74 is coupled to shaft 96 to provide a rotational force for rotating shaft 96, and in turn, valve member 94. Drive source 74 has a controller (not shown) in communication with a temperature sensor unit 114 having individual sensor elements 114-1,114-2 for detecting the temperature of each of first and second particulate traps 68, 70, respectively. Drive source 74 can have any of a plurality of well-known transmission devices, such as, for example, a gear train or belt system, for transmitting rotational power to shaft 96 from an existing source of rotary motion, such as for example, the crankshaft, camshaft or fuel pump of the internal combustion engine. It is further contemplated that drive source 74 can include other sources for providing rotary motion, such as for example, an electric motor or a turbine.

Referring to FIG. 2, first particulate filter 78 forms a porous structure having a plurality of passages 116, depicted by a multitude of dots, that facilitate bidirectional fluid flow between first fluid port 80 and second fluid port 82. Likewise, second particulate filter 86 forms a porous structure having a plurality of passages 118, depicted by a multitude of dots, that facilitate bi-directional fluid flow between third fluid port 88 and fourth fluid port 90. Such a porous structure can be achieved, for example, by a plurality metallic or ceramic objects, such as screens, corrugated plates, or spheres. The passages 116, 118 are sized to trap particulate material that is present in the EGR gases supplied by EGR source 24 prior to the EGR gases being received at intake manifold 18.

INDUSTRIAL APPLICABILITY

During operation, combustion gases, i.e., exhaust gases, are exhausted from block 16 via exhaust manifold 20 (see FIG. 1). A first portion of the combustion gases a supplied to turbine 34 of turbocharger 22, which in turn rotates to drive compressor 36. Compressor 36 supplies a flow of compressed air through ATAAC 28 to intake manifold 18.

A second portion of the combustion gases is received by EGR source 24, which in turn supplies EGR gases to EGR inlet port 98 of regenerator valve 72. The EGR gases are filtered by a selected one of particulate traps 68, 70, and the filtered EGR gases are then supplied for mixing with compressed air from compressor 36 prior to or during entry into intake manifold 18. The determination of which of first and second particulate traps 68, 70 will be used for filtering EGR gases will be based on the respective temperatures detected by temperature sensors 114-1, 114-2. During filtering, the selected particulate trap removes heat from the EGR gases flowing therethrough. Once the selected particulate trap reaches a critical temperature, drive source 74 rotates valve member 94 to select the other of the two particulate traps 68, 70 for filtering. A portion of compressed air from compressor 36 is bled (hereinafter bleed air) from conduit segment 56-2 and is supplied to back flush the other of particulate traps 68, 70 that was not selected for filtering EGR gases, and thereby cools the non-filtering particulate trap.

Referring to FIGS. 1 and 2, when valve member 94 of regenerator valve 72 is positioned in the first position, an EGR gases fluid flow is directed in a first direction depicted by arrow 120 through first particulate filter 78 of first particulate trap 68 and a compressed air fluid flow is directed in a second direction depicted by arrow 122, opposite to first direction 120, through second particulate filter 86 of second particulate trap 70. When valve member 94 of regenerator valve 72 is positioned in the second position, the EGR gases fluid flow is directed in first direction 120 through second particulate filter 86 of second particulate trap 70 and the compressed air fluid flow is directed in second direction 122, opposite to first direction 120, through first particulate filter 78 of first particulate trap 68.

Thus, while valve member 94 of regenerator valve 72 is in the first position, at the time that first particulate filter 78 in first particulate trap 68 is trapping particulate material present in the EGR gases fluid flow through first particulate filter 78, second particulate filter 86 of second particulate trap 70 is being cleaned by a back-flow of the compressed bleed air to purge previously collected, i.e., trapped, particulate material from second particulate filter 86 of second particulate trap 70.

During this process, heat from the EGR gases fluid flow is stored in first particulate trap 68, and in particular, in first particulate filter 78. Heat previously stored in second particulate trap 70, and in particular, second particulate filter 86, is released to heat the compressed air fluid flow to generate a warmed purge air flow. In turn, the warmed purge air flow is supplied to exhaust manifold 20. The flow rate of the warmed purge air flow can be regulated by purge air valve 106.

Likewise, while valve member 94 of regenerator valve 72 is in the second position, at the time that second particulate filter 86 in second particulate trap 70 is trapping particulate material present in the EGR gases flowing through second particulate filter 86, first particulate filter 78 of first particulate trap 68 is being cleaned by a back-flow of the compressed bleed air to purge previously collected, i.e., trapped, particulate material from first particulate filter 78 of first particulate trap 68.

During this process, heat from the EGR gases fluid flow is stored in second particulate trap 70, and in particular, in second particulate filter 86. Heat previously stored in first particulate trap 68, and in particular, first particulate filter 78, is released to heat the compressed bleed air fluid flow to generate a warmed purge air flow. In turn, the warmed purge air flow is supplied to exhaust manifold 20. Again, the flow rate of the warmed purge air flow can be regulated by purge air valve 106.

In using the invention, valve member 94 of regenerator valve 72 is rotated by alternate clockwise and counter clockwise rotations between the first and second positions by angular increments, such as for example by 180 degrees, defined by rotation impeding elements 97-1, 97-2. Alternatively, in the absence of rotation impeding elements 97-1, 97-2, drive source 74 can rotatably drive valve member 94 of regenerator valve 72 in 180 degree increments in a single rotational direction.

Thus, according to the invention, the ERG gases/air mixture which will be introduced to intake manifold 18 will include compressed air and filtered EGR gases, thereby reducing that amount of contaminants introduced to the intake side of internal combustion engine 14. In addition, by providing continuous cleaning of one of the two particulate traps 68, 70, the useful life of corresponding particulate filters 78, 86 is increased over that of stationary filters of similar size. Still further, during back flushing of particulate filters 78, 86, heat energy stored in the corresponding particulate filters 78, 86 during filtering is released to warm the compressed bleed air, which in turn is introduced into the exhaust manifold 20 to replace some of the energy lost by the process of providing EGR.

Other aspects and features of the present invention can be obtained from study of the drawings, the disclosure, and the appended claims.

What is claimed is:

1. An exhaust gas regenerator/particulate capture system, comprising:

a first particulate trap having a first housing containing a first particulate filter, said first housing having a first fluid port and a second fluid port;

a second particulate trap having a second housing containing a second particulate filter, said second housing having a third fluid port and a fourth fluid port;

a regenerator valve having a valve body and a valve member, said valve body having an EGR inlet port, a purge air outlet port, a first particulate trap port and a second particulate trap port, said first particulate trap port being connected in fluid communication with said first fluid port of said first particulate trap and said second particulate trap port being connected in fluid communication with said third fluid port of said second particulate trap, said valve member being operable between a first position and a second position, wherein when said valve member is in said first position, said EGR inlet port is connected in fluid communication with said first particulate trap and said purge air outlet port is connected in fluid communication with said second particulate trap, and when said valve member is in said second position, said EGR inlet port is connected in fluid communication with said second particulate trap and said purge air outlet port is connected in fluid communication with said first particulate trap.

2. The exhaust gas regenerator/particulate capture system of claim 1, wherein said valve member is coupled to a shaft, said shaft being rotatable with respect to said valve body, said exhaust gas regenerator/particulate capture system including a drive source coupled to said shaft to provide a rotational force for rotating said shaft, thereby rotating said valve member.

3. The exhaust gas regenerator/particulate capture system of claim 1, wherein each of said first particulate filter and said second particulate filter forms a porous structure having a plurality of passages.

4. The exhaust gas regenerator/particulate capture system of claim 3, wherein said plurality of passages are sized to trap particulate material that is present in EGR gases flowing through said porous structure.

5. The exhaust gas regenerator/particulate capture system of claim 1, including:

an EGR source providing an EGR gases fluid flow coupled to said EGR inlet port; and a compressed air source providing a compressed air fluid flow coupled to each of said first particulate trap and said second particulate trap, wherein when said valve member is positioned in said first position, said EGR gases fluid flow is directed in a first direction through said first particulate filter and said compressed air fluid flow is directed in a second direction opposite to said first direction through said second particulate filter, and wherein when said valve member is positioned in said second position, said EGR gases fluid flow is directed in said first direction through said second particulate filter and said compressed air fluid flow is directed in said second direction opposite to said first direction through said first particulate filter.

6. An internal combustion engine, comprising:

a block defining a plurality of combustion cylinders;

an intake manifold connected to said block for providing combustion air to each of said plurality of combustion cylinders;

an exhaust manifold connected to said block to receive combustion gases from said plurality of combustion cylinders;

an air conduit;

a turbocharger having a turbine and a compressor, said turbine having an exhaust gas inlet port and an exhaust gas outlet port, said compressor having an air inlet port and an air outlet port, said exhaust gas inlet port of said turbine being coupled in fluid communication with said exhaust manifold, said air inlet port of said compressor being in fluid communication with the atmosphere, and said air outlet port being coupled in fluid communication with said intake manifold via said air conduit;

an EGR source connected in fluid communication with said exhaust manifold;

a first particulate trap having a first housing containing a first particulate filter, said first housing having a first fluid port and a second fluid port, said second fluid port being connected in fluid communication with said combustion air conduit;

a second particulate trap having a second housing containing a second particulate filter, said second housing having a third fluid port and a fourth fluid port, said fourth fluid port being connected in fluid communication with said combustion air conduit; and a regenerator valve having a valve body and a valve member, said valve body having an EGR inlet port, a purge air outlet port, a first particulate trap port and a second particulate trap port, said EGR inlet port being connected in fluid communication with said EGR source, said purge air outlet port being connected in fluid communication with said exhaust manifold, said first particulate trap port being connected in fluid communication with said first fluid port of said first particulate trap and said second particulate trap port being connected in fluid communication with said third fluid port of said second particulate trap, and said valve member being operable between a first position and a second position, wherein when said valve member is in said first position, said EGR inlet port is connected in fluid communication with said first particulate trap and said purge air outlet port is connected in fluid communication with said second particulate trap, and when said valve member is in said second position, said EGR inlet port is connected in fluid communication with said second particulate trap and said purge air outlet port is connected in fluid communication with first particulate trap.

7. The internal combustion engine of claim 6, wherein said valve member is a rotary device coupled to a shaft, and said shaft being rotatable with respect to said valve body, said internal combustion engine including a drive source coupled to said shaft to provide a rotational force for rotating said shaft, thereby rotating said valve member.

8. The internal combustion engine of claim 6, wherein each of said first particulate filter and said second particulate filter forms a porous structure having a plurality of passages.

9. The internal combustion engine of claim 8, wherein said plurality of passages are sized to trap particulate material that is present in EGR gases flowing through said porous structure.

10. The internal combustion engine of claim 6, wherein when said valve member is positioned in said first position, an EGR gases fluid flow is directed in a first direction through said first particulate filter and a compressed air fluid flow is directed in a second direction opposite to said first direction through said second particulate filter, and wherein when said valve member is positioned in said second position, said EGR gases fluid flow is directed in said first direction through said second particulate filter and said compressed air fluid flow is directed in said second direction opposite to said first direction through said first particulate filter.

11. The internal combustion engine of claim 6, wherein said first position is defined by a first rotation impeding element and said second position is defined by a second rotation impeding element.

12. A method of filtering EGR gases, comprising the steps of:

providing a first particulate trap;

providing a second particulate trap;

providing a valve having a valve member;

establishing an EGR gases fluid flow;

establishing a compressed air fluid flow;

positioning said valve member in a first position to effect said EGR gases fluid flow in a first direction through said first particulate trap and to effect said compressed air fluid flow in a second direction opposite to said first direction through said second particulate trap; and positioning said valve member in a second position to effect said EGR gases fluid flow in said first direction through said second particulate trap and to effect said compressed air fluid flow in said second direction opposite to said first direction through said first particulate trap.

13. The method of claim 12, including the step of selecting which of the positioning steps is to be performed based on a temperature of each of said first particulate trap and said second particulate trap.

14. The method of claim 12, wherein said selecting step is performed by rotating said valve member from one of said first position and said second position to the other of said first position and said second position.

15. The method of claim 12, wherein when said valve member is in said first position, said compressed air fluid flow removes particulate material trapped in said second particulate trap, and when said valve member is in said second position, said compressed air fluid flow removes particulate material trapped in said first particulate trap.

16. The method of claim 12, wherein when said valve member is in said first position, heat from said EGR gases fluid flow is stored in said first particulate trap and stored heat in said second particulate trap is released to heat said compressed air fluid flow to generate a warmed purge air flow, said method including the step of supplying said warmed purge air flow to an exhaust manifold of an internal combustion engine.

17. The method of claim 12, wherein when said valve member is in said second position, heat from said EGR gases fluid flow is stored in said second particulate trap and stored heat in said first particulate trap is released to heat said compressed air fluid flow to generate a warmed purge air flow, said method including the step of supplying said warmed purge air flow to an exhaust manifold of an internal combustion engine.

* * * * *